US006918756B2

(12) United States Patent
Fredricks et al.

(10) Patent No.: US 6,918,756 B2
(45) Date of Patent: Jul. 19, 2005

(54) SYSTEM AND METHODS FOR MODULATING GAS INPUT TO A GAS BURNER

(75) Inventors: Thomas J. Fredricks, Wildwood, MO (US); Donald E. Donnelly, Fenton, MO (US); Russell T. Shoemaker, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 249 days.

(21) Appl. No.: 09/903,484

(22) Filed: Jul. 11, 2001

(65) Prior Publication Data

US 2003/0013054 A1 Jan. 16, 2003

(51) Int. Cl.[7] ..... F23C 10/28
(52) U.S. Cl. ..... 431/12
(58) Field of Search ..... 431/12, 89, 90

(56) References Cited

U.S. PATENT DOCUMENTS 5,860,411 A 1/1999 Thompson et al.
5,878,741 A 3/1999 Dempsey et al.
2002/0051321 A1 * 2/2002 La Fontaine ..... 431/12

* cited by examiner

*Primary Examiner*—Henry Bennett
*Assistant Examiner*—Sabrina Dagostino
(74) *Attorney, Agent, or Firm*—Harness Dickey & Pierce PLC

(57) ABSTRACT

An improved gas appliance having a burner, a gas valve through which the flow of combustion gas to the burner is controlled, and a motor driven blower that supplies combustion air to the burner. The improvement includes means for increasing gas flow through the gas valve as blower speed increases, and decreasing gas flow through the gas valve as blower speed decreases, based on a pressure signal generated independently of combustion air pressure. This improvement allows a constant ratio of gas to air to be maintained in the burner while a combustion flow rate varies dependent on the blower motor revolutions per minute. Thus input pressures of combustion can be controlled at low cost.

13 Claims, 4 Drawing Sheets

SYSTEM AND METHODS FOR MODULATING GAS INPUT TO A GAS BURNER

FIELD OF THE INVENTION

The present invention relates generally to gas appliances and, more particularly, to controls for gas input to gas appliances.

BACKGROUND OF THE INVENTION

Gas appliances typically include valves for controlling gas input to the appliance's burners. Gas control valves are used in induced draft systems and in forced draft systems with pressure-assist modulation (PAM) to deliver gas to be combined with air for combustion. It is desirable to control gas and air input pressures in order to achieve desired combustion rates in appliance burners. One method of controlling gas input pressure is to electronically modulate gas control valve output relative to the air input pressure, by using a pressure transducer. Such an approach, however, is expensive.

SUMMARY OF THE INVENTION

The present invention in one embodiment is an improved gas appliance having a burner, a gas valve through which the flow of combustion gas to the burner is controlled, and a motor driven blower that supplies combustion air to the burner. The improvement includes means for increasing the flow of gas through the gas valve as the blower speed increases, and decreasing the flow of gas through the gas valve as the blower speed decreases, based on a pressure signal generated independently of the combustion air pressure. In a preferred embodiment, a pump provided on the shaft of the blower motor is driven by the blower motor to generate the pressure signal for controlling the gas valve.

The above-described system allows a constant ratio of gas to air to be maintained to the burner while a combustion flow rate varies dependent on the blower motor revolutions per minute. Thus input pressures to the burner can be simply and reliably controlled at low cost.

DETAILED DESCRIPTION OF THE PREFERRED EMBODIMENT

Figure 1:
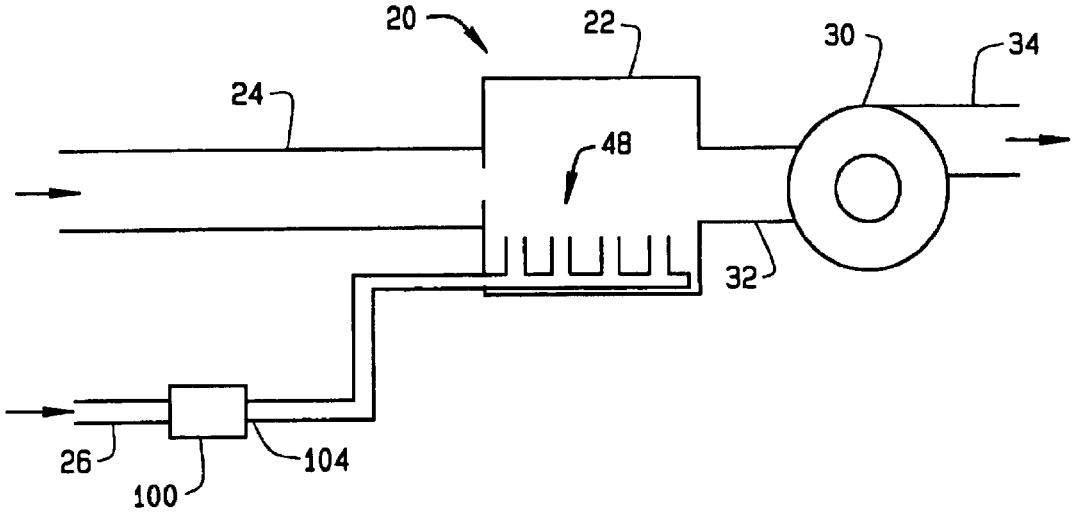
FIG. 1 PRIOR ART
FIG. 1 is a schematic diagram of a conventional induced draft combustion system.

A conventional induced draft combustion system is indicated generally as 20 in FIG. 1. The combustion system 20 comprises a combustion chamber 22 having a burner 48 therein, an air inlet 24, and a gas inlet 26. A gas valve 100 in the gas inlet 26 controls the flow of gas to the burner. A blower 30, having an inlet 32 and an outlet 34 connected to the combustion chamber 22 draws the hot combustion gases from the combustion chamber to, for example, the heat exchanger of a residential furnace or commercial heater, thereby drawing air through the air inlet 24 into the combustion chamber. In a conventional system shown in FIG. 1, increasing the speed of the blower 30 increases the air flow to the combustion chamber 22, but it does not affect the flow of gas to the combustion chamber 22. Thus, changes to the blower speed change the air to fuel ratio. Additionally, increasing the speed of the blower 30 typically increases air flow to the combustion chamber 22 up to pressures of only about 2.5 inches of water column.

Figure 2:
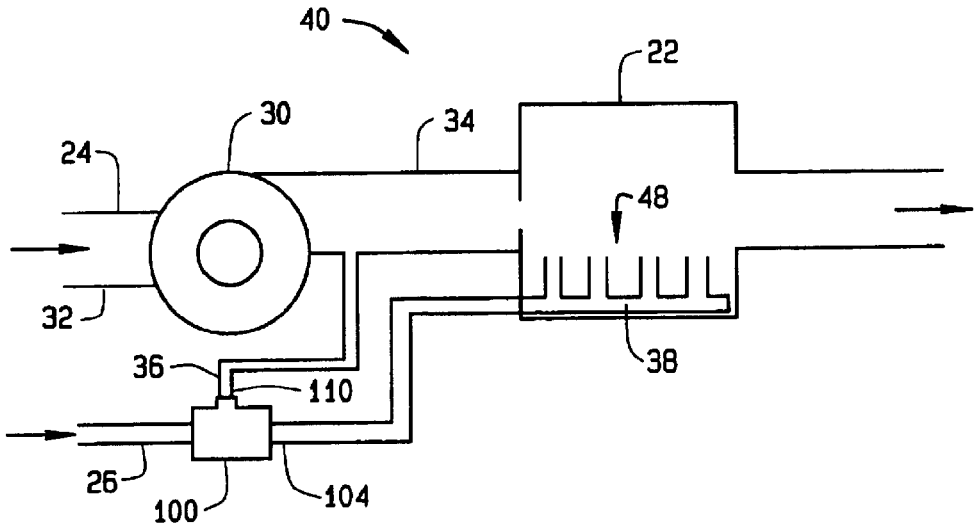
FIG. 2 PRIOR ART
FIG. 2 is a schematic diagram of a conventional forced draft PAM system.

A conventional forced draft PAM system is indicated generally as 40 in FIG. 2. The forced draft system 40 comprises a combustion chamber 22 having a burner 48 therein, an air inlet 24, and a gas inlet 26. A gas valve 100 in the gas inlet 26 controls the flow of gas to the burner. A blower 30, having an inlet 32 and an outlet 34 between the air inlet and the combustion chamber 22 pushes air into the combustion chamber, thereby pushing hot combustion gases from the combustion chamber 22 to, for example, the heat exchanger of a residential furnace or commercial heater. Gas flow is adjusted via a hose line 36 connecting the blower outlet 34 and a port 110 on the gas valve 100. In the conventional PAM forced draft system shown in FIG. 2, increasing the speed of the blower 30 increases the air flow to the combustion chamber and affects the flow of gas to the burner. The blower 30, however, produces pressure signals only up to about 2.5 inches of water column. Because gas valves typically operate at pressures above 3 inches of water column for natural gas and at pressures above 10 inches of water column for liquefied petroleum (LP) gas, changes to the blower speed could change the air to fuel ratio when requiring gas valve operation at pressures above 3 inches of water column.

Figure 3:
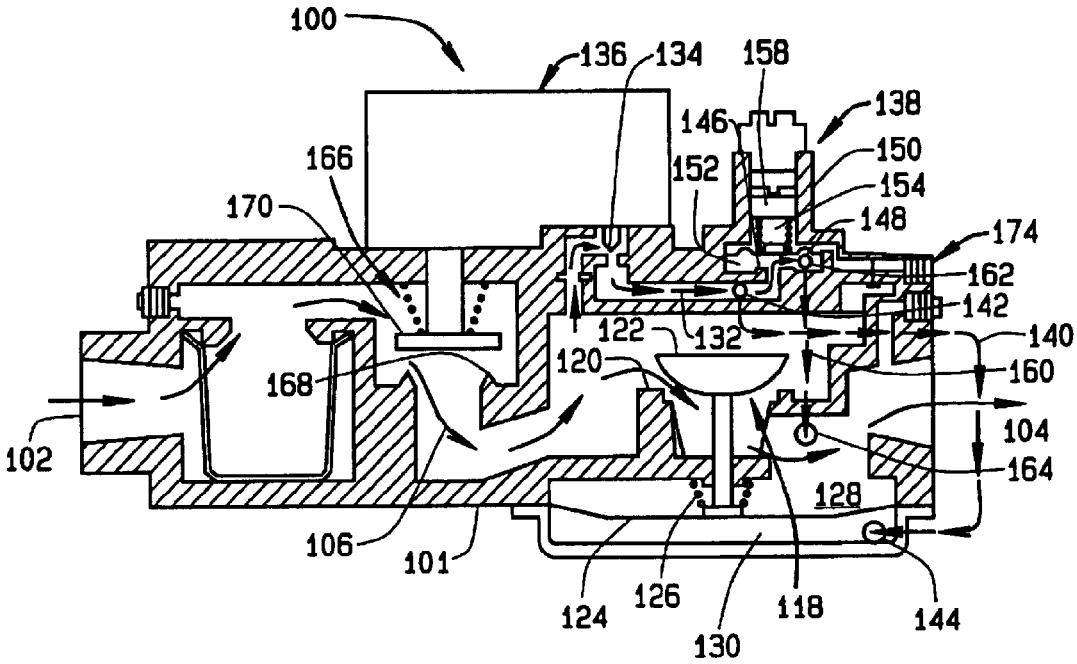
FIG. 3 is a vertical cross sectional view of a gas valve adapted for use with the present invention.
Figure 4:
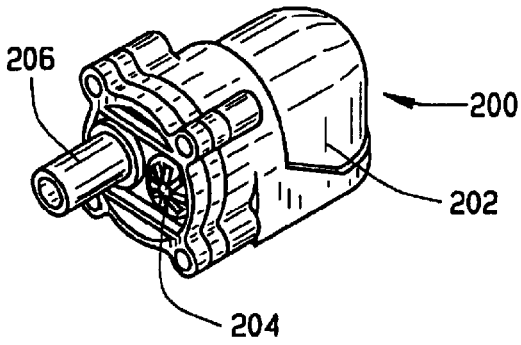
FIG. 4 is a perspective view of a pump adapted for use with the present invention.
Figure 5:
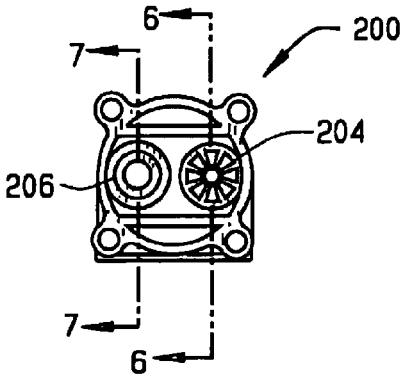
FIG. 5 is a front elevation view of the pump.
Figure 6:
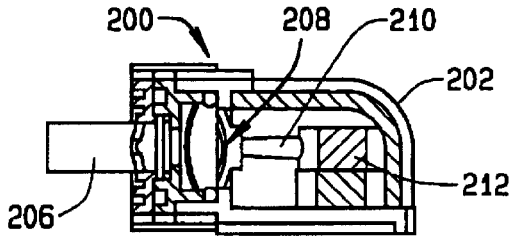
FIG. 6 is a vertical longitudinal cross-sectional view of the pump taken along the plane of line 6—6 in FIG. 5.
Figure 7:
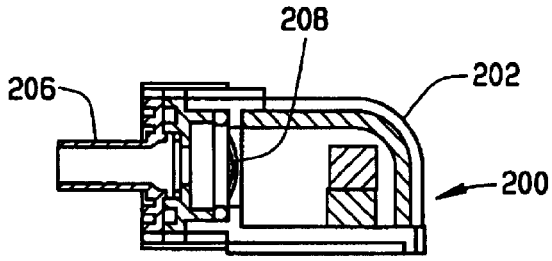
FIG. 7 is a vertical longitudinal cross-sectional view of the pump taken along the plane of line 7—7 in FIG. 5.
Figure 8:
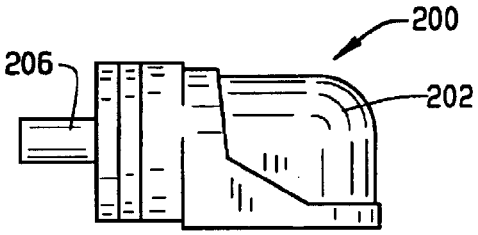
FIG. 8 is a side elevation view of the pump.
Figure 9:
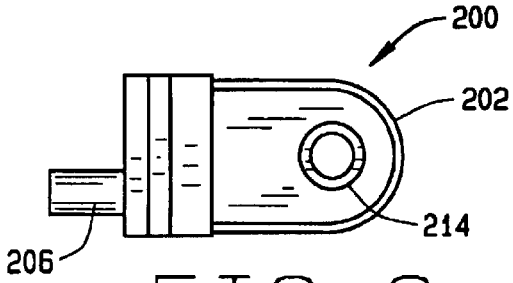
FIG. 9 is a bottom plan view of the pump.

The present invention is a system and method whereby the fuel gas flow rate is automatically adjusted with changes in the blower speed to substantially maintain the air to fuel ratio despite changes in the blower speed. The system includes a gas valve shown generally as 100 in FIG. 3. The gas valve 100 is similar to conventional gas valves, except for the provision of a port for receiving pressure signal from the blower, as described in more detail below. As shown in FIG. 3, the gas valve 100 comprises a body 101 having an inlet 102, an outlet 104, and a flow path 106 therebetween. There is a main valve 118 adjacent the outlet 104. The main valve 118 comprises a valve seat 120, and a valve stem 122, which is controlled by a diaphragm 124, and biased closed by a spring 126. The diaphragm 124 defines an upper chamber 128 and a lower chamber 130 in the valve 100. The relative pressures in the upper and lower chambers 128 and 130 determine the position of the valve stem 122 relative to the seat 120, and thus whether the flow path 106 in the valve 100 is open or closed.

A control conduit 132, selectively closed by a control valve 134 operated by a control solenoid 136, extends to a regulator 138. A passage 140 has a port 142 opening to the control conduit 132, and a port 144 opening to the lower chamber 130. Thus, when the control valve 134 is open, the inlet gas pressure is communicated via conduit 132 and passage 140 to lower chamber 130, which causes the stem 122 to move and open the main valve 118.

The regulator 138 includes a valve seat 146 and a diaphragm 148 that seats on and selectively closes the valve seat 146, and which divides the regulator into upper and lower chambers 150 and 152. There is a spring 154 in the upper chamber 150 on one side of the diaphragm 148. The relative pressures in the upper and lower chambers 150 and 152 determine the position of the diaphragm 148 relative to the valve seat 146, and thus the operation of the regulator 138. A screw adjustment mechanism 158 compresses the spring 154 and adjusts the operation of the regulator 138. A passage 160 has a port 162 opening to the lower chamber 152 of the regulator 138, and a port 164 opening to the upper chamber 128 of the valve. When the regulator valve is open, i.e. when the diaphragm 148 is not seated on valve seat 146, the inlet gas pressure is communicated via passage 160 to the upper chamber 128, tending to equalize the pressure between the upper and lower chambers 128 and 130, and close the main valve 118.

A secondary valve 166, comprising a valve seat 168, a valve member 170, and solenoid 136, is disposed in the flow path 106 between the inlet 102 and the main valve 118. The secondary valve 166 also closes the gas valve 100, acting as a back up to the main valve 118.

In accordance with this preferred embodiment, the regulator 138 includes a port 174 that communicates with the upper chamber 150 for receiving a pressure signal from a blower-driven pump as further described below. The pressure signal on the port 174 changes the operating point of the regulator. When the pressure signal from port 174 increases the pressure in the upper chamber 150 of the regulator, the regulator valve closes passage 160, tending to increase the opening of the main valve 118. When the pressure signal from the port 174 decreases the pressure in the upper chamber 150 of the regulator, the regulator valve closes less readily, keeping passage 160 open, and tending to close the main valve. Thus the port 174 provides feed back control, increasing gas flow with an increase in blower speed, and decreasing gas flow with a decrease in blower speed.

In accordance with this invention, the pressure signal is preferably created by the operation of the blower motor. In the preferred embodiment, a pump is provided on the shaft of the blower motor. Rotation of the blower motor shaft operates the pump, and the outlet pressure of the pump is substantially proportional to the speed of the blower motor.

A pump adapted for use with the present invention is indicated generally as 200 in FIGS. 4 through 9. The pump 200 comprises a housing 202 having a one-way air inlet 204 and an air outlet 206. A diaphragm 208 in the housing 202 is operated by the reciprocation of a shaft 210, which in turn is driven by cam 212. The cam 212 is operatively connected to shaft of the blower motor. The pump 200 has a socket 214 for engaging the shaft of the blower motor. Thus the pressure generated by the pump changes with the speed of the blower motor.

Figure 10:
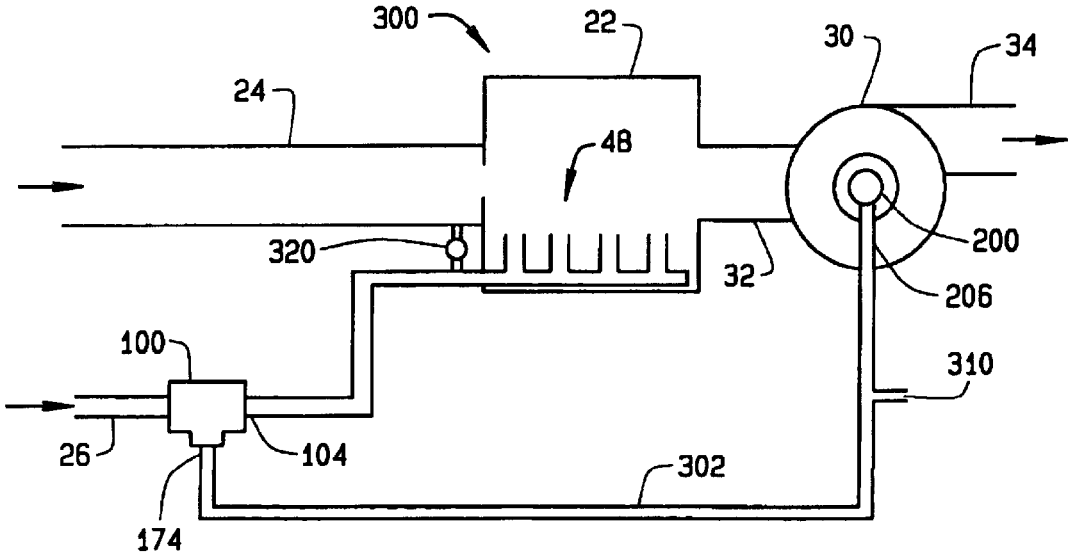
FIG. 10 is a schematic diagram of an induced draft combustion system constructed according to the principles of this invention.

An induced draft combustion system constructed according to the principles of this invention is indicated generally as 300 in FIG. 10. The combustion system 300 is similar in construction to system 20 described above, and corresponding parts are identified with corresponding reference numerals. The combustion system 300 comprises a combustion chamber 22 having a burner 48 therein, an air inlet 24, and a gas inlet 26. A gas valve 100 in the gas inlet 26 controls the flow of gas to the burner 48. A blower 30 connected to the combustion chamber draws the hot combustion gases from the combustion chamber 22 to, for example, the heat exchanger of a residential furnace or commercial heater, thereby drawing air through the air inlet 24 into the combustion chamber.

In system 300, a pump 200 is mounted on the shaft of the motor of the blower 30. The outlet 206 (shown in FIGS. 4–9) of the pump 200 is connected to the port 174 in gas valve 100 via line 302, to adjust the operation of the regulator with changes in the blower speed, thereby tending to maintain the air to fuel ratio as the blower speed changes. The pump outlet pressure is generated independently of, and can exceed, the combustion air pressure generated by the blower 30. Thus an adjustable bleed orifice 310 of the line 302 is used to adjust the pump pressure signal to the gas valve 100. Thus the pump 200, line 302, orifice 310 and port 174 operate as a controller that increases the flow of gas through the gas valve 100 as the blower speed increases, and decreases the flow of gas through the gas valve 100 as the blower speed decreases, based on a pressure signal substantially proportional to drive shaft revolutions of the blower motor.

A differential pressure switch 320 between the air inlet 24 and gas valve outlet 104 is configured to sense both gas flow and air flow into the combustion chamber 22. When a predetermined difference in gas flow and air flow is sensed, the switch 320 cooperates, for example, with a system 300 ignition or blower motor control (not shown) to shut down the system 300. Thus an automatic shutoff is performed if, for example, lint accumulates in the air inlet 24 in such amounts that the predetermined difference in gas and air pressures is detected.

Figure 11:
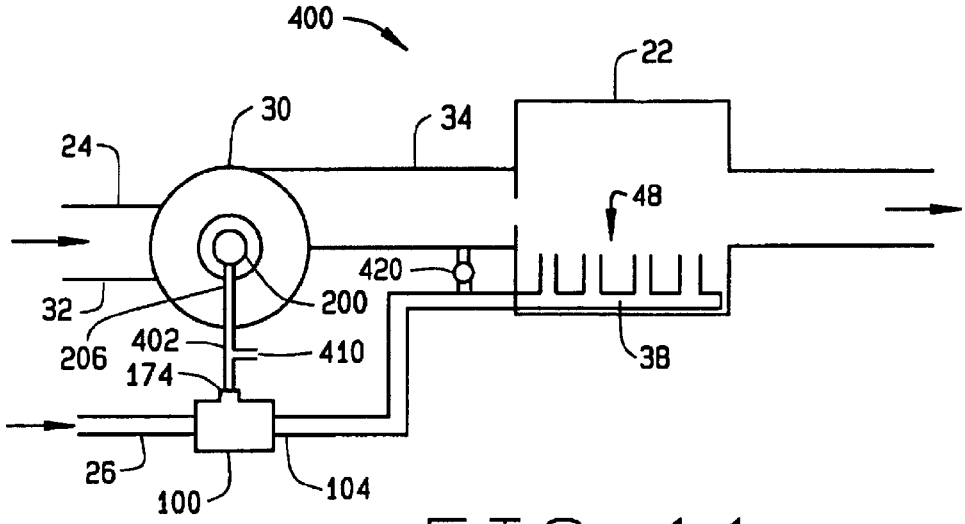
FIG. 11 is a schematic diagram of a forced draft PAM system constructed according to the principles of this invention.

A PAM combustion system constructed according to the principles of this invention is indicated generally as 400 in FIG. 11. The combustion system 400 is similar in construct to system 40, described above, and corresponding parts are identified with corresponding reference numerals. The combustion system 400 comprises a combustion chamber 22 having a burner 48 therein, an air inlet 24, and a gas inlet 26. A gas valve 100 in the gas inlet 26 controls the flow of gas to the burner 48. A blower 30 between the air inlet and the combustion chamber pushes air into the combustion chamber, thereby pushing hot combustion gases from the combustion chamber 22 to, for example, the heat exchanger of a residential furnace or commercial heater. In system 400, a pump 200 is mounted on the shaft of the motor of the blower 30. The outlet 206 (shown in FIGS. 4–9) of the pump 200 is connected to the port 174 in gas valve 100 via a line 402, to adjust the operation of the regulator with changes in the blower speed, thereby tending to maintain the air to fuel ratio as the blower speed changes. The pump outlet pressure is generated independently of, and can exceed, the combustion air pressure generated by the blower 30. Thus an adjustable bleed orifice 410 of the line 402 is used to adjust the pump pressure signal to the gas valve 100. Thus the pump 200, line 402, orifice 410 and port 174 operate as a controller that increases the flow of gas through the gas valve 100 as the blower speed increases, and decreases the flow of gas through the gas valve 100 as the blower speed decreases, based on a pressure signal substantially proportional to drive shaft revolutions of the blower motor.

A differential pressure switch 420 between the blower outlet 34 and gas valve outlet 104 is configured to sense both gas flow and air flow into the combustion chamber 22. When a predetermined difference in gas flow and air flow is sensed, the switch 420 cooperates, for example, with a system 400 ignition or blower motor control (not shown) to shut down the system 400.

It is apparent from the foregoing that the relationship between inches of pump outlet pressure and RPMs of the blower motor is substantially linear, and that the pump 200 is capable of generating pressures exceeding typical blower generated combustion air pressures of up to 2.5 inches of water column.

The above system and method provide for maintaining a constant ratio of gas to air going to a furnace while varying a combustion flow rate dependent on blower motor revolutions per minute. Because the pump 200 generates a pressure signal dependent on the blower motor speed, gas flow can be modulated without sensing or sampling combustion air pressure. The pump can be configured with gas valves that operate at pressures above, below and including two inches of water column. More specifically, the pump can provide pressures of up to fourteen inches of water column. Thus the pump produces pressures sufficient for use in gas appliances having burners using either natural or LP gas, and also is inexpensive to manufacture. Thus input pressures of combustion can be controlled at low cost.

Other changes and modifications may be made to the above described embodiments without departing from the scope of the present invention, as recognized by those skilled in the art. Thus the invention is to be limited only by the scope of the following claims and their equivalents.

What is claimed is:

1. An improved gas appliance having a burner, a gas valve through which the flow of combustion gas to the burner is controlled, and a motor driven blower which supplies combustion air to the burner, the improvement comprising means for increasing the flow of gas through the gas valve as the blower speed increases, and decreasing the flow of gas through the gas valve as the blower speed decreases, based on a control pressure that is generated independently of the combustion air pressure and is input to the gas valve.

2. The improved gas appliance according to claim 1 wherein the control pressure is generated dependent on the blower motor speed.

3. An improved gas appliance having a burner, a gas valve through which the flow of combustion gas to the burner is controlled, and a motor driven blower which supplies combustion air to the burner, the improvement comprising a controller configured to increase the flow of gas through the gas valve as the blower speed increases, and decrease the flow of gas through the gas valve as the blower speed decreases, based on a pressure signal input to the gas valve and having pressure capable of exceeding the combustion air pressure.

4. The improved gas appliance according to claim 3 wherein the gas valve decreases the flow rate as the pressure signal increases, and increases the flow rate as the pressure signal increases.

5. The improved gas appliance according to claim 3 wherein the controller comprises a pump for providing the pressure signal to the gas valve.

6. The improved gas appliance according to claim 5 wherein the pump is driven by the blower motor.

7. The improved gas appliance according to claim 3 wherein the controller further comprises an adjustable bleed orifice configured to adjust the pressure signal relative to the gas flow.

8. The improved gas appliance according to claim 3 wherein the blower pushes air into the burner.

9. The improved gas appliance according to claim 3 wherein the blower draws air through the burner.

10. The improved gas appliance according to claim 3 wherein the controller further comprises a differential pressure switch configured to deactivate the appliance based on a predetermined pressure difference between gas flow and air flow into the burner.

11. In combination with a gas appliance having a burner, a gas valve through which the flow of gas to the burner is controlled based on a pressure signal, a motor-driven blower for providing combustion air to the burner, and a controller for controlling the flow of gas through the gas valve, a pump configured to provide a pressure signal to the controller dependent on blower motor speed, said pump further configurable to provide pressure signals sufficient to operate appliances utilizing a plurality of types of gas.

12. The combination according to claim 11 wherein the pump is configured to maintain a substantially constant gas-to-air ratio going to the appliance burner.

13. The combination according to claim 12 wherein the pump is configured to provide a pressure signal of up to about fourteen inches of water column to the controller.

* * * * *